US010301984B2

(12) United States Patent
Jang et al.

(10) Patent No.: US 10,301,984 B2
(45) Date of Patent: May 28, 2019

(54) ENGINE OIL PAN

(71) Applicants: Hyundai Motor Company, Seoul (KR); Kia Motors Corporation, Seoul (KR)

(72) Inventors: Hong Woon Jang, Suwon-si (KR); Min Gyun Chae, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/695,971

(22) Filed: Sep. 5, 2017

(65) Prior Publication Data

US 2018/0179926 A1 Jun. 28, 2018

(30) Foreign Application Priority Data

Dec. 26, 2016 (KR) ..... 10-2016-0178704

(51) Int. Cl.
*F01M 11/00* (2006.01)

(52) U.S. Cl.
CPC ... *F01M 11/0004* (2013.01); *F01M 2011/002* (2013.01); *F01M 2011/0062* (2013.01)

(58) Field of Classification Search
CPC ..... F01M 2011/002; F01M 2011/0062; F01M 2005/023
See application file for complete search history.

(56) References Cited

U.S. PATENT DOCUMENTS 5,218,938 A * 6/1993 Miller ..... F01M 11/0004 123/195 C
2010/0162988 A1* 7/2010 Enokida ..... F01M 11/0004 123/195 C
2010/0300395 A1* 12/2010 Enokida ..... F01M 11/0004 123/195 R
2011/0147128 A1* 6/2011 Schrade ..... B29C 45/22 184/106
2012/0190255 A1* 7/2012 Yamazaki ..... B63B 35/731 440/88 L
2015/0252696 A1* 9/2015 Taguchi ..... F01M 11/0004 123/198 E
2016/0222846 A1* 8/2016 Mizoguchi ..... F02F 11/00

FOREIGN PATENT DOCUMENTS

KR 10-2007-0079737 A 8/2007

* cited by examiner

*Primary Examiner* — Long T Tran
(74) *Attorney, Agent, or Firm* — Morgan, Lewis & Bockius LLP

(57) ABSTRACT

A sealing portion deformation reducing type engine oil pan having a main compartment portion for storage of engine oil, may include a pan bottom portion configured to surround a bottom of the main compartment portion; a pan side portion configured to surround a side of the main compartment portion; and a flange portion configured to be formed at an upper portion of the pan side portion and mounted with a sealing gasket, wherein a reinforcing rib is disposed at a lower portion of the flange portion while being formed at an opening of the fan side portion.

5 Claims, 4 Drawing Sheets

ENGINE OIL PAN

CROSS-REFERENCE(S) TO RELATED APPLICATIONS

The present application claims priority to Korean Patent Application No. 10-2016-0178704 filed on Dec. 26, 2016, the entire contents of which are incorporated herein for all purposes by this reference.

BACKGROUND OF THE INVENTION

Field of the Invention

The present invention relates to a sealing portion deformation reducing type engine oil pan, and more particularly, to a sealing portion deformation reducing type engine oil pan capable of minimizing deformation due to a vibration of a sealing gasket compressed between a cylinder block of an engine and an oil pan mounted on the cylinder block, and stably securing sealing performance of a gasket.

Description of Related Art

Generally, an oil pan configured for storage of engine oil for lubrication and cooling of the engine is mounted on the bottom of a cylinder block of an automobile engine and a sealing gasket is mounted between the cylinder block and the oil pan to prevent oil in the oil pan from over flowing due to a traveling vibration and a road surface vibration of a vehicle from leaking oil to the outside.

A flange portion formed at an upper part of the oil pan is fixedly mounted on the bottom of the cylinder block. At the present point, the sealing gasket mounted on the flange portion prevents oil from leaking between the cylinder block and the flange portion.

Meanwhile, the existing oil pan is made of various materials such as steel, aluminum, and plastic. Here, the oil pan made of a plastic material may have a lighter weight than that made of steel or aluminum, but may have low stiffness against a vibration transferred from the engine. Due to the above problem, the sealing performance of the sealing gasket deteriorates, which leads to a durability problem and a quality problem due to an oil leak.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a sealing portion deformation reducing type engine oil pan configured for stably securing durability performance and sealing performance of a sealing gasket by reducing the deformation of the sealing gasket applying a surface pressure and a reaction force to a flange portion when the sealing gasket is compressed in a state in which the sealing gasket is mounted on the flange portion, by forming a reinforcing rib at a lower portion of the flange portion of the oil pan on which the sealing gasket is mounted to reinforce the stiffness of the flange portion coupled to the cylinder block of the engine, and reducing deformation of the flange portion due to the vibration transferred from the engine.

Various aspects of the present invention are directed to providing a sealing portion deformation reducing type engine oil pan having a main compartment portion for storage of engine oil, including: a pan bottom portion configured to surround a bottom of the main compartment portion, a pan side portion configured to surround a side of the main compartment portion, and a flange portion configured to be formed at an upper portion of the pan side portion, and mounted with a sealing gasket, wherein a reinforcing rib is disposed at a lower portion of the flange portion while being formed at an opening of the pan side portion.

In an exemplary embodiment, one side of the main compartment portion may be provided with a side compartment portion connected to the main compartment portion through the opening and the reinforcing rib may be formed between the main compartment portion and the side compartment portion.

In another exemplary embodiment, the other side of the main compartment portion may be provided with a sub compartment portion connected to the main compartment portion through the opening, the reinforcing rib may be formed between the main compartment portion and the side compartment portion, and the sub compartment portion may be formed at a side opposite to the side compartment portion with respect to the main compartment portion.

In still another exemplary embodiment, the reinforcing rib may be formed at one or more positions between the longitudinal ribs formed at the pan side portion.

In another exemplary embodiment, the reinforcing rib is formed between a left edge portion of the opening and a longitudinal rib adjacent to the left edge portion and between a right edge portion of the opening and a longitudinal rib adjacent to the right edge portion part.

In yet another exemplary embodiment, the reinforcing rib may be formed from a lower end portion of the pan side portion provided with the opening to block some area of an upper portion of the opening, and the reinforcing rib may be formed in an arch shape in which a lower end portion of the reinforcing rib is bent upwardly.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
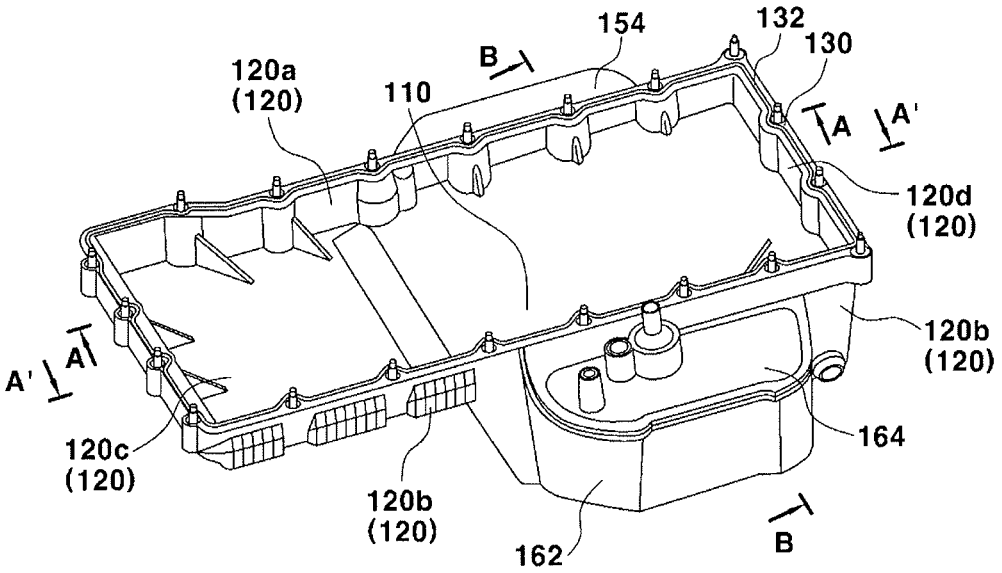
FIG. 1 is a perspective view illustrating an engine oil pan according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

As known, in an engine oil pan that is an oil pan mounted on a bottom of a cylinder block of an engine, a flange portion at an upper portion of the oil pan is fixedly mounted on the bottom of the cylinder block, and when the flange portion is mounted on the bottom of the cylinder block, a sealing gasket disposed on an upper surface (interface with the cylinder block) of the flange portion is compressed, the gasket prevents oil and gas (gas generated from oil in the oil pan) from leaking between the oil pan and the cylinder block in the state in which the gasket is compressed.

The gasket is generally made of a rubber material having elasticity and applies a surface pressure and a reaction force to the flange portion of the oil pan during compression. Therefore, as deformation of the flange portion occurs, deformation of the gasket occurs.

In general, the oil pan receives a vibration transferred from the engine, and is deformed due to the vibration. At the present point, the deformation of the flange portion occurs while the vibrational state of the oil pan is changed according to a vibration frequency of the engine, and thus the deformation of the gasket occurs thereby causing deterioration in durability and a reduction in sealing performance of the gasket.

In particular, an oil pan made of a plastic material has a stiffness much lower than that of an oil pan made of a steel material and an oil pan made of an aluminum material, and therefore is vulnerable to the deformation due to the vibration transferred from the engine, wherein the deformation of the oil pan is large and accordingly the deformation of the gasket is large, greatly reducing the durability and the sealing performance of the gasket.

Accordingly, the stiffness of the engine oil pan is increased and thus the deformation amount (shift speed) due to the vibration transferred from the engine may be reduced and minimized.

According to an exemplary embodiment of the present invention, a reinforcing rib is formed at a lower portion of the flange portion mounted with the sealing gasket to increase the stiffness of the flange portion and the structural stiffness of the oil pan, wherein the deformation of the flange portion and the deformation of the gasket mounted on the flange portion due to the vibration transferred from the engine may be reduced and minimized.

Hereinafter, exemplary embodiments of the present invention will be described in detail with reference to the accompanying drawings.

Figure 2A:
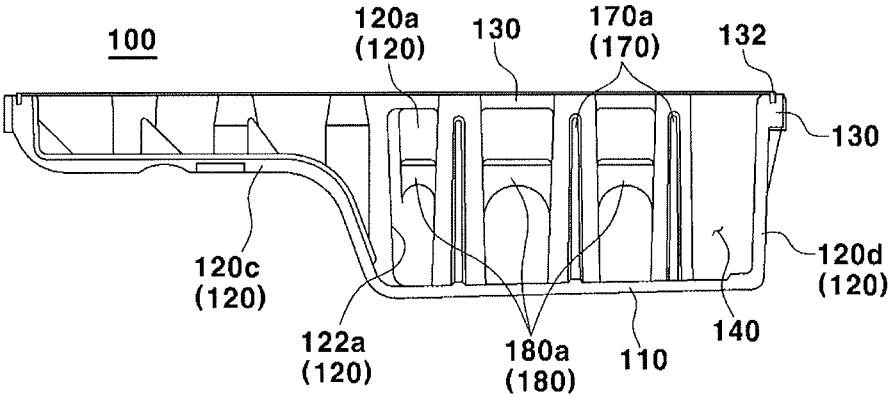
FIG. 2A is a view taken along the line A-A of FIG. 1.
Figure 2B:
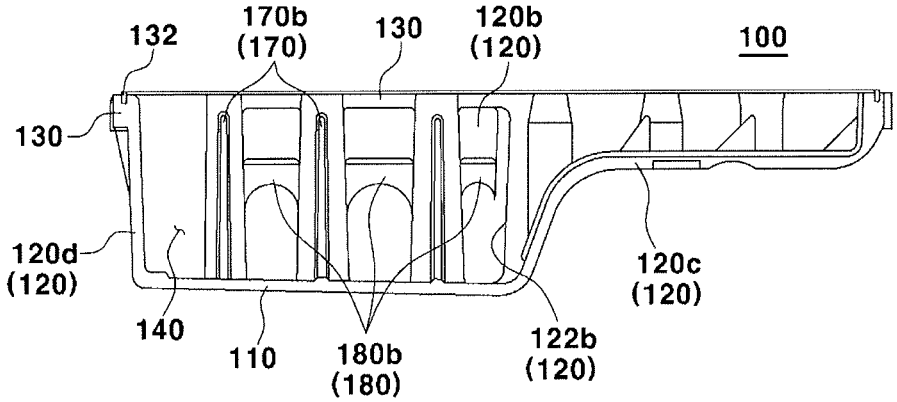
FIG. 2B is a view taken along the line A'-A' of FIG. 1.
Figure 3:
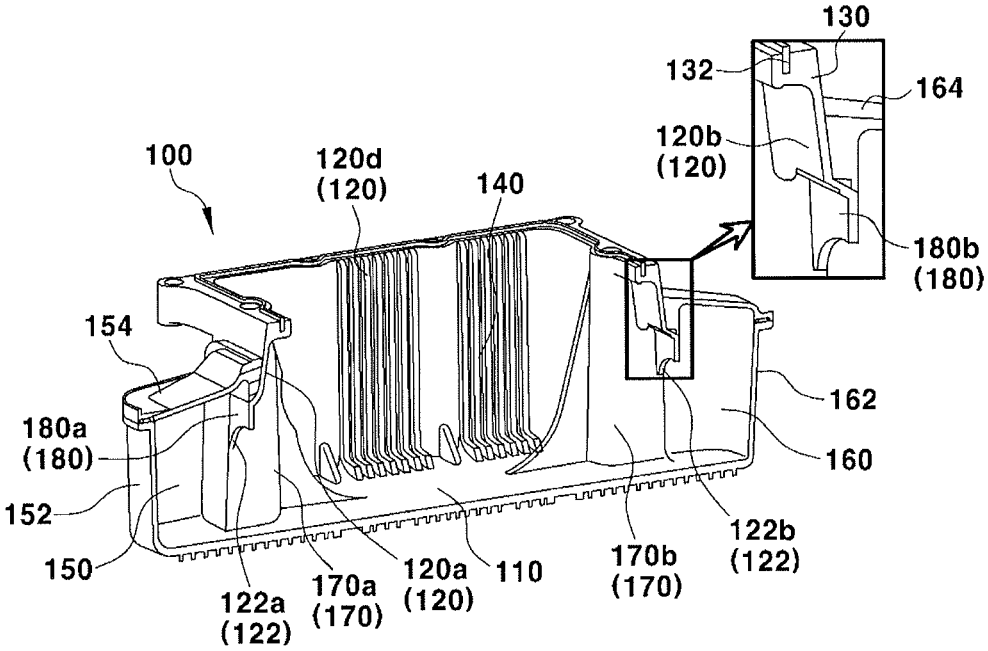
FIG. 3 is a view taken along B-B' of FIG. 1.

As illustrated in FIG. 1 to FIG. 3, an oil pan 100 has a main compartment portion 140 for storing engine oil, in which the main compartment portion 140 which is a compartment surrounded with a pan bottom portion 110 and a pan side portion 120 has a form in which an upper surface of the main compartment portion 140 is open.

In other words, the oil pan 100 is an oil storage pan that includes the pan bottom portion 110 surrounding a bottom of the main compartment portion 140 and the pan side portion 120 surrounding a side of the main compartment portion 140 has a form in which an upper portion of the oil pan 100 is open and is formed with a flange portion 130 mounted in a state in which a sealing gasket 132 is partially inserted into an upper portion of the pan side portion 120.

The flange portion 130 is coupled to the bottom of the cylinder block using a fastening member or the like when the oil pan 100 is mounted on the bottom of the cylinder block of the engine, and has a predetermined width and thickness for mounting the gasket 132, the fastening member, or the like, and has a thickness greater than that of the pan side portion 120.

The main compartment portion 140 has a substantially rectangular cross-sectional structure and pan side portions 120*a*, 120*b*, 120*c*, and 120*d* are formed to surround sides in four directions of the main compartment portion 140. Here, the side in one direction is surrounded in the form in which one pan side portion 120*c* is stepped (see FIG. 2A and FIG. 2B) and thus a bottom height of the main compartment portion 140 is divided into two, wherein the main compartment portion 140 is formed of two compartments having different heights (or depths).

Further, the oil pan 100 has a side compartment portion 150 formed at one side of the main compartment portion 140 so that the side compartment portion 150 is connected to the main compartment portion 140, and a sub compartment portion 160 formed at the other side of the main compartment portion 140 so that the sub compartment portion 160 is connected to the main compartment portion 140. The side compartment portion 150 and the sub compartment portion 160 are formed to be connected to a deeper compartment (referred to as 'oil storage portion' substantially as a compartment in which oil is stored) of the two compartments forming the main compartment 140, and are disposed at both sides of the oil storage portion to face each other and communicate with the main compartment portion 140 to make an oil flow possible.

The side compartment portion 150 and the sub compartment portion 160 are differentiated from the main compartment portion 140 with respect to the pan side portions 120*a* and 120*b*, which have openings, among the pan side portions 120*a*, 120*b*, 120*c*, and 120*d*, and communicate with the main compartment portion 140 to make an oil flow possible through each opening 122*a* and 122*b*.

In other words, the opening (i.e., side opening) 122*a* of the pan side portion 120*a* is formed at a boundary between the main compartment portion 140 and the side compartment portion 150, and the opening (i.e., sub opening) 122*b* of the pan side portion 120*b* is formed at the boundary between the main compartment portion 140 and the sub compartment portion 160.

The pan side portions 120*a* and 120*b*, in which the openings 122*a* and 122*b* are formed, are provided with a plurality of longitudinal ribs 170*a* and 170*b* to reinforce the stiffness that is reduced by the openings 122*a* and 122*b*, and the longitudinal ribs 170*a* and 170*b* extend from the flange portion 130 formed at the upper portion of the pan side portions 120*a* and 120*b* to the pan bottom portion 110 and pass through the openings 122*a* and 122*b* in a longitudinal direction.

Further, the oil pan 100 has a plurality of reinforcing ribs 180*a* and 180*b* formed in the openings 122*a* and 122*b* of the pan side portions 120*a* and 120*b* at a lower portion of the flange portion 130, wherein the structural stiffness of the oil pan 100 is increased, and at the same time the stiffness of the flange portion 130 is increased. The present case is because the reinforcing ribs 180*a* and 180*b* are disposed at the lower portion of the flange portion 130 through the pan side portions 120*a* and 120*b* so that the stiffness of the flange portion 130 is increased.

The plurality of reinforcing ribs 180*a* are formed in the side opening 122*a* of the pan side portion 120*a* corresponding to the boundary between the main compartment portion 140 and the side compartment portion 150. The plurality of reinforcing ribs 180*b* are formed in the sub opening 122*b* of the pan side portion 120*b* corresponding to the boundary between the main compartment portion 140 and the sub compartment portion 160. The sub compartment portion 160 is formed at the side opposite to the side compartment portion 150 with respect to the main compartment portion 140.

The sub compartment portion 160 and the side compartment portion 150 are symmetrically formed with respect to the main compartment portion 140, or formed in a similar shape.

Further, the bottoms of the sub compartment portion 160 and the side compartment portion 150 are surrounded with the pan bottom portion 110 surrounding the bottom of the main compartment portion 140. The side of the sub compartment portion 160 is surrounded with a sub side portion 162, and the side of the side compartment portion 150 is surrounded with the side portion 152.

The sub compartment portion 160 surrounded with the sub side portion 162 and the side compartment portion 150 surrounded with the side portion 152 protrude outwards from the oil pan 100 with respect to the main compartment portion 140 surrounded with the pan side portions 120*a*, 120*b*, 120*c*, and 120*d*, and upper surfaces thereof are covered with cover member 154 and 164 respectively.

The sub compartment portion 160 and the side compartment portion 150 communicate with the lower portion of the main compartment portion 140 with respect to the flange portion 130 and have depths lower than the highest depth of the main compartment portion 140 but deeper than the lowest depth of the main compartment portion 140.

Further, the reinforcing ribs 180*a* and 180*b* formed in the openings 122*a* and 122*b* are formed at one or more places between the left or right edge portion (or edge portion parts of the pan side portions 120*a* and 120*b* adjacent to the left or right edge portion of the openings 122*a* and 122*b*) of the openings 122*a* and 122*b* and a longitudinal rib that is closest to the edge portion part, and between the longitudinal ribs that are closest to each other.

For example, as illustrated in FIG. 2A, the reinforcing ribs 180*a* are integrally formed between the left or right edge portion of the side opening 122*a* and the longitudinal rib closest to the edge portion part, and between the longitudinal ribs adjacent to each other in the side opening 122*a*, respectively.

Further, for example, as illustrated in FIG. 2B, the reinforcing ribs 180*b* formed in the sub opening 122*b* are also formed in the same or similar structure as the reinforcing ribs 180*a* formed in the side opening 122*a*. Specifically, the reinforcing ribs 180*b* are integrally formed between the left or right edge portion of the sub opening 122*b* and the longitudinal rib closest to the edge portion part, and between the longitudinal ribs adjacent to each other in the sub opening, respectively.

The reinforcing ribs 180*a* and 180*b* formed in the openings 122*a* and 122*b* are formed from the upper end portions of the openings 122*a* and 122*b* (i.e., lower end portions of the pan side portions 120*a* and 120*b* in which the openings are formed) to block some area of the upper portion of the openings.

The reinforcing ribs 180*a* and 180*b* are formed in an arch shape (or inversed U shape) in which the lower end portions of the reinforcing ribs 180*a* and 180*b*, that is, the lower end portions of the reinforcing ribs 180*a* and 180*b* facing the pan bottom portion 110, are bent upwards and are formed in a plate shape in which the thickness of the reinforcing ribs 180*a* and 180*b* is the same as or similar to that of the pan side portions 120*a* and 120*b*.

When the lower end portions of the reinforcing ribs 180*a* and 180*b* are formed in an arch shape, it is advantageous in that the durability of the reinforcing ribs 180*a* and 180*b* withstanding a load is increased.

Figure 4:
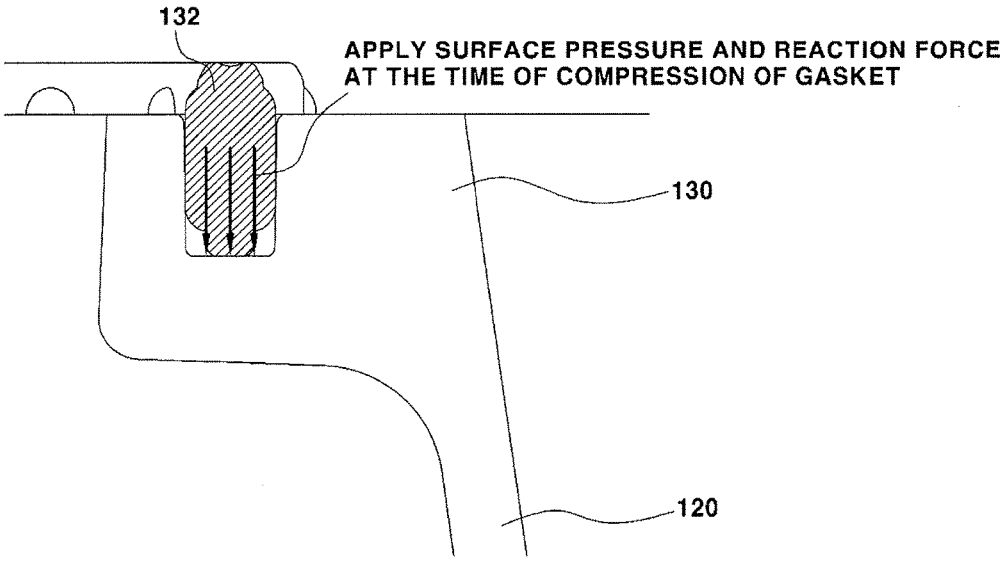
FIG. 4 is an enlarged view of a flange portion of the engine oil pan according to an exemplary embodiment of the present invention.

Accordingly, the openings 122*a* and 122*b* of the pan side portions 120*a* and 120*b* formed at the lower portion of the flange portion 130 are provided with the arched reinforcing ribs 180*a* and 180*b* to increase the stiffness of the oil pan 100, in particular, the stiffness of the flange portion 130, wherein the shift speed (in other words, deformation amount) of the flange portion 130 may be reduced. By doing so, the deformation amount of the flange portion 130 is reduced, and thus the deformation due to the vibration of the gasket 132 (see FIG. 4) applying the surface pressure and the reaction force to the flange portion 130 at the time of the compression of the gasket may be reduced.

Further, as the deformation due to the vibration of the gasket 132 is reduced, the durability of the gasket 132 is improved and the reduction in the sealing performance of the gasket 132 against the interface between the cylinder block of the engine and the oil pan 100 is minimized, wherein the sealing performance of the gasket 132 may be stably secured.

Further, the oil pan 100 in which the openings 122*a* and 122*b* formed at the lower portion of the flange portion 130 are provided with the reinforcing ribs 180*a* and 180*b* is difficult to be structurally implemented in the case of the existing steel oil pan or aluminum oil pan, whereas the oil pan 100 in which the openings 122*a* and 122*b* formed at the lower portion of the flange portion 130 are provided with the reinforcing ribs 180*a* and 180*b* may be implemented due to the characteristics of a plastic material in the case of the plastic oil pan.

Therefore, the above-mentioned arched reinforcing ribs 180 are applied to the plastic oil pan having a stiffness lower than that of the existing steel oil pan or aluminum oil pan, and thus the stiffness of the oil pan including the flange portion may be increased and the deformation of the flange portion by the vibration transferred from the engine may be reduced to reduce the deformation of the gasket, stably securing the durability and the sealing performance of the gasket.

Figure 5:
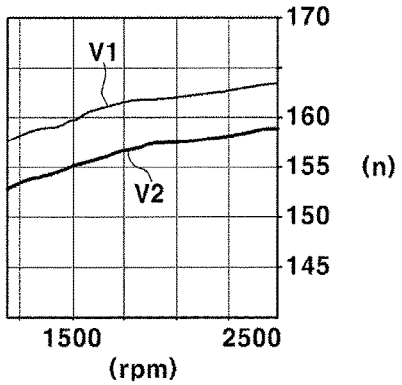
FIG. 5 is a graph illustrating results of oil pan vibration evaluation in an actual vehicle.
Figure 6:
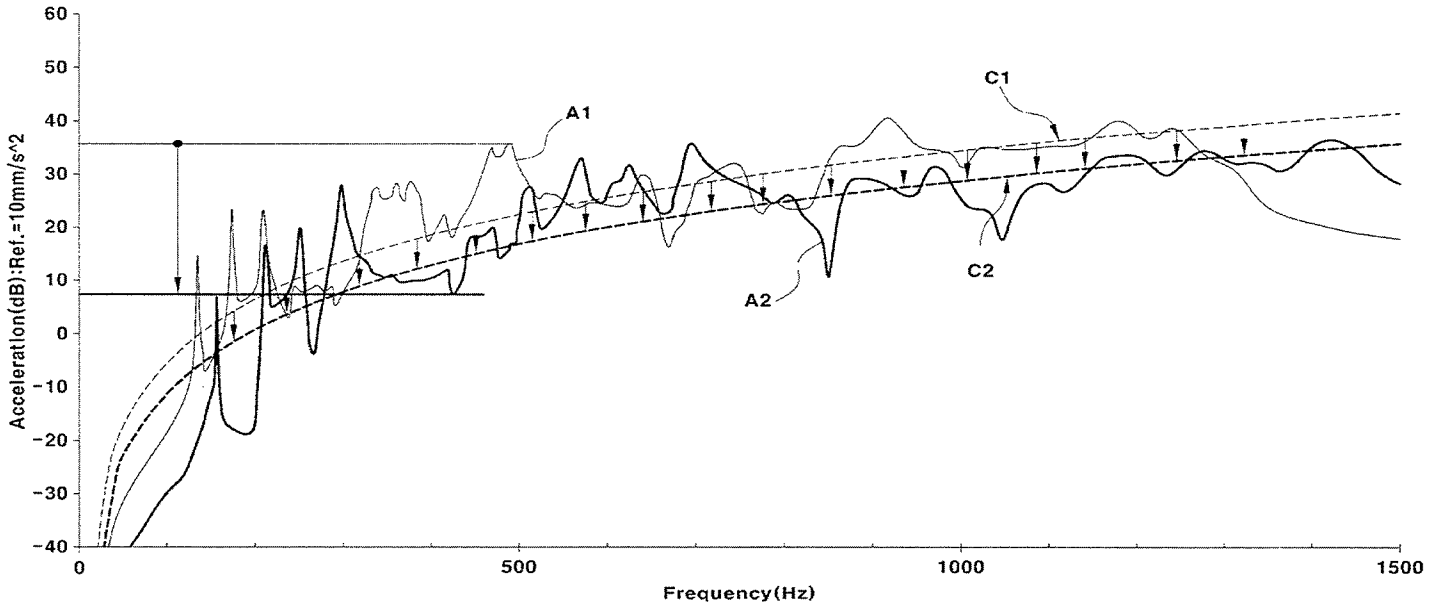
FIG. 6 is a graph illustrating a shift speed and stiffness of the flange portion of the oil pan according to a vibration frequency of the engine.

Meanwhile, FIG. 5 is a graph depicting the results of an oil pan vibration evaluation in an actual vehicle, and FIG. 6 is a graph depicting the shift speed and stiffness of the flange portion of the oil pan according to the vibration frequency of the engine.

As illustrated in FIG. 5, the results confirmed that a frequency V2 of the plastic oil pan to which the reinforcing rib is applied is more reduced than a frequency V1 of the plastic oil pan to which the reinforcing rib is not applied. For reference, the frequencies V1 and V2 are shown by measuring a frequency (n/rpm) of the oil pan depending on an engine RPM under the same conditions except for the application of the reinforcing ribs.

As a result of measuring the deformation amount of the flange portion before and after the measurement of the frequency of the plastic oil pan to which the reinforcing rib is not applied and the deformation amount of the flange portion before and after the measurement of the frequency of the plastic oil pan to which the reinforcing rib is applied, the deformation amount of the flange portion of the plastic oil pan to which the reinforcing rib is not applied is 0.5583 mm @140° C. and the deformation amount of the flange portion of the plastic oil pan to which the reinforcing rib is applied is 0.4974 mm @140° C., and therefore it could be confirmed that the deformation amount of the flange portion of the plastic oil pan to which the reinforcing rib is applied is smaller.

Further, referring to FIG. 6, as a result of measuring the shift speed (deformation amount) of the flange portion of the plastic oil pan according to the vibration frequency of the engine, the results confirmed that a shift speed A2 of the flange portion of the plastic oil pan to which the reinforcing rib is applied is smaller than a shift speed A1 of the flange portion of the plastic oil pan to which the reinforcing rib is not applied.

In addition, as a result of converting the shift speeds A1 and A2 into dynamic stiffness and comparing them, the dynamic stiffness according to the shift speed A2 is more reduced than that according to the shift speed A1, wherein it could be confirmed that stiffness C2 of the flange portion of the plastic oil pan to which the reinforcing rib is applied is increased more than the stiffness C1 of the flange portion of the plastic oil pan to which the reinforcing rib is not applied.

Here, the shift speed (dB) is a value obtained by measuring a speed at which a predetermined amount (10 mm/s$^2$) of deformation per unit time occurs. Accordingly, it is possible to figure out the deformation amount of the flange portion occurring per unit time based on the value of the shift speed.

The engine oil pan according to an exemplary embodiment of the present invention may obtain the following effects by forming the reinforcing rib at the lower portion of the flange portion coupled to the cylinder block of the engine.

As the structural stiffness of the oil pan is increased, the stiffness of the flange portion may be increased.

Accordingly, as the deformation amount against the vibration transferred from the engine is reduced, and in particular, the deformation amount of the flange portion is reduced, the deformation of the sealing gasket mounted on the flange portion may be reduced.

As a result, the durability and the sealing performance of the gasket may be stably secured, thereby preventing the quality problem associated with the oil leakage of the oil pan.

For convenience in explanation and accurate definition in the appended claims, the terms "upper", "lower", "up", "down", "upwards", "downwards", "front", "rear", "back", "internal", "outer", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A sealing portion deformation reducing type engine oil pan having a main compartment for storage of engine oil, the sealing portion deformation reducing type engine oil pan comprising:

a pan bottom portion configured to surround a bottom of the main compartment;

a pan side portion configured to surround a side of the main compartment; and a flange portion configured to be formed at an upper portion of the pan side portion and mounted with a sealing gasket, wherein a first reinforcing rib is disposed at a lower portion of the flange portion while being formed with a first opening of the pan side portion, wherein one side of the main compartment is provided with a sub compartment connected to the main compartment through the first opening, the first reinforcing rib to which the first opening is formed, is mounted between the main compartment and the sub compartment, wherein another side of the main compartment is provided with a side compartment connected to the main compartment through a second opening and a second reinforcing rib to which the second opening is formed, is mounted between the main compartment and the side compartment, and wherein the sub compartment is formed at a side opposite to the side compartment with respect to the main compartment.

2. The sealing portion deformation reducing type engine oil pan of claim 1, wherein the first and second reinforcing ribs are formed at one or more places of between longitudinal ribs formed at the pan side portion.

3. The sealing portion deformation reducing type engine oil pan of claim 1, wherein the first reinforcing rib extends between a first edge portion of the first opening and a first longitudinal rib adjacent to the first edge portion and the second reinforcing rib extends between a second edge portion of the second opening and a second longitudinal rib adjacent to the second edge portion.

4. The sealing portion deformation reducing type engine oil pan of claim 1, wherein the first and second reinforcing ribs extend to a lower end portion of the pan side portion provided with the first opening and the second opening to block a predetermined area of an upper portion of the first opening and the second opening.

5. The sealing portion deformation reducing type engine oil pan of claim 4, wherein the first and second reinforcing ribs are formed in an arch shape in which a lower end portion of each of the first and second reinforcing ribs is bent upwardly.

* * * * *